US010048000B2

(12) United States Patent
Rillo Millán et al.

(10) Patent No.: US 10,048,000 B2
(45) Date of Patent: Aug. 14, 2018

(54) GAS LIQUEFACTION SYSTEM AND METHOD

(71) Applicants: CONSEJO SUPERIOR DE INVESTIGACIONES CIENTÍFICAS (CSIC), Madrid (ES); UNIVERSIDAD DE ZARAGOZA, Saragossa (ES); GWR INSTRUMENTS, INC., San Diego, CA (US)

(72) Inventors: Conrado Rillo Millán, Saragossa (ES); Leticia Tocado Martínez, Saragossa (ES); Richard C. Reineman, La Jolla, CA (US); Richard J. Warburton, Del Mar, CA (US)

(73) Assignees: CONSEJO SUPERIOR DE INVESTIGACIONES CIENTÍFICAS (CSIC), Madrid (ES); GWR INSTRUMENTS, INC., San Diego, CA (US); UNIVERSIDAD DE ZARAGOZA, Zaragoza (ES)

( * ) Notice: Subject to any disclaimer, the term of this patent is extended or adjusted under 35 U.S.C. 154(b) by 62 days.

(21) Appl. No.: 13/801,960

(22) Filed: Mar. 13, 2013

(65) Prior Publication Data

US 2013/0192273 A1 Aug. 1, 2013

Related U.S. Application Data

(63) Continuation of application No. 13/664,096, filed on Oct. 30, 2012, which is a continuation-in-part of (Continued)

(30) Foreign Application Priority Data

May 3, 2010 (ES) ..... 201030658

(51) Int. Cl.
*F25J 1/02* (2006.01)
*F25B 9/00* (2006.01)
*F25J 1/00* (2006.01)

(52) U.S. Cl.
CPC ..... *F25J 1/02* (2013.01); *F25B 9/00* (2013.01); *F25J 1/0007* (2013.01); *F25J 1/0225* (2013.01);
(Continued)

(58) Field of Classification Search
CPC ..... F25B 9/00; F25J 1/02; F25J 1/0007; F25J 2215/30
(Continued)

(56) References Cited

U.S. PATENT DOCUMENTS 4,608,831 A * 9/1986 Gustafson ..... F17C 3/08 137/341
5,150,578 A 9/1992 Oota et al.
(Continued)

FOREIGN PATENT DOCUMENTS

GB 457054 A 11/1936
WO WO 2009087307 A2 * 7/2009 ..... F25J 1/0022

OTHER PUBLICATIONS

WO 2009087307 A2 Translation.*
(Continued)

*Primary Examiner* — Brian King
(74) *Attorney, Agent, or Firm* — Stetina Brunda Garred and Brucker; Mark B. Garred

(57) ABSTRACT

A system and a method for liquefaction of gases which are utilized in their liquid state as refrigerants in applications that require low temperatures, throughout various pressure ranges, from slightly above atmospheric pressures to pressures near the critical point. The system and method are based on closed-cycle cryocoolers and utilize the thermo-
(Continued)

dynamic properties of the gas to achieve optimal liquefaction rates.

17 Claims, 5 Drawing Sheets

Related U.S. Application Data application No. PCT/US2011/034842, filed on May 2, 2011.

(52) U.S. Cl.
CPC ..... *F25J 1/0276* (2013.01); *F25J 2270/908* (2013.01); *F25J 2270/912* (2013.01)

(58) Field of Classification Search
USPC ..... 62/47.1, 48.1, 49.1, 49.2, 51.1, 77, 121, 62/129, 149, 177, 178
See application file for complete search history.

(56) References Cited

U.S. PATENT DOCUMENTS 5,228,299 A * 7/1993 Harrington et al. ..... 62/55.5
5,293,750 A * 3/1994 Tamura ..... F17C 13/02 62/47.1
5,671,603 A * 9/1997 McCorkle ..... F17C 13/021 137/392
6,378,312 B1 4/2002 Wang
7,213,400 B2 5/2007 Dickerson et al.
7,555,916 B2 7/2009 Dickerson et al.
8,327,650 B2 2/2012 Clayton et al.
2005/0044951 A1* 3/2005 Forshey ..... G01F 13/00 73/215
2005/0229609 A1* 10/2005 Kirichek ..... F25B 9/02 62/6
2006/0010909 A1* 1/2006 Briglia ..... F25J 3/04084 62/606
2006/0260327 A1* 11/2006 Kanamori et al. ..... 62/6
2007/0204632 A1* 9/2007 Lee ..... 62/51.1
2008/0016907 A1* 1/2008 Barclay ..... F25B 9/14 62/612
2009/0049863 A1 2/2009 Wang
2009/0094992 A1* 4/2009 Wang ..... F25B 9/10 62/6
2009/0293505 A1 12/2009 Wang

OTHER PUBLICATIONS

Helium liquefaction with a commercial 4K Gifford-McMahon cryocooler; ScienceDirect, Cryogenics 46 (2006), pp. 799-803.
International Search Report (PCT/US2011/034842, dated May 2, 2011) 2 pages.
International Preliminary Report on Patentability (PCT/US2011/034842, dated Nov. 15, 2012) 7 pages.
EPO Office Action for Application No. EP 11 720 246.5, dated Jan. 15, 2016.

* cited by examiner

GAS LIQUEFACTION SYSTEM AND METHOD

CROSS REFERENCE TO RELATED APPLICATIONS

This is a continuation of U.S. patent application Ser. No. 13/664,096, filed 30 Oct. 2012, which is a continuation-in-part of PCT/US2011/034842, filed 2 May 2011, which claims priority from Spanish patent application P201030658, filed 3 May 2010, all of which are incorporated by reference in their entireties.

FIELD OF INVENTION

This invention relates generally to systems and methods for liquefaction of gases, and more particularly to such systems and methods adapted for improved liquefaction and performance efficiency.

BACKGROUND

Helium is a scarce element on earth and its numerous scientific and industrial applications continue to drive a growing demand. For example, common uses of gas-phase helium include welding, lifting (balloons), and semiconductor and fiber optic manufacturing. In the liquid phase, common uses include refrigeration of certain medical and scientific equipment, purging fuel tanks (NASA), and basic research in solid-state physics, magnetism, and a wide variety of other research topics. Because of the widespread utility of helium, its limited availability, and the finite reserves of helium, it is considered a high-cost non-renewable resource. Accordingly, there is an increasing interest in recycling helium and similar noble gases.

In particular, liquid helium is used as the refrigerant in many applications in which it is necessary to reach temperatures below −200° C. Such applications are frequently related to the use of superconductors, and particularly in low-temperature physics research equipment which operates in evacuated and insulated containers or vacuum flasks called Dewars or cryostats. Such cryostats contain a mixture of both the gas and liquid phases and, upon evaporation, the gaseous phase is often released to the atmosphere. Therefore it is often necessary to purchase additional helium from an external source to continue the operation of the equipment in the cryostat.

One of liquid helium's most important applications is to refrigerate the high magnetic field superconducting coils used in magnetic resonance imaging (MRI) equipment, which provides an important diagnostic technique by non-invasively creating images of the internal body for diagnosing a wide variety of medical conditions in human beings.

The largest users of liquid helium are large international scientific facilities or installations, such as the Large Hadron Collider at the CERN international laboratory. Laboratories such as CERN recover, purify, and re-liquefy the recovered gas through their own large scale (Class L) industrial liquefaction plants, which typically produce more than 100 liters/h and require input power of more than 100 kW. For laboratories with more moderate consumption, medium (Class M) liquefaction plants are available that produce about 15 liters/hour. These large and medium liquefaction plants achieve a performance, R, of about 1 liter/hour/kW (24 liters/day/kW) when the gas is pre-cooled with liquid nitrogen, and about 0.5 liters/hour/kW (12 liters/day/kW) without pre-cooling.

For smaller scale applications small-scale refrigerators are now commercially available which are capable of achieving sufficiently low temperatures to liquefy a variety of gases and, in particular, to liquefy helium at cryogenic temperatures below 4.2 Kelvin. In the industry, these small-scale refrigerators are normally referred to as closed-cycle cryocoolers. These cryocoolers have three components: (1) a coldhead (a portion of which is called the "cold finger" and typically has one or two cooling stages), where the coldest end of the cold finger achieves very low temperatures by means of the cyclical compression and expansion of helium gas; (2) a helium compressor which provides high pressure helium gas to and accepts lower pressure helium gas from the coldhead; and (3) the high and low pressure connecting hoses which connect the coldhead to the helium compressor. Each of the one or more cooling stages of the cold finger has a different diameter to accommodate variations in the properties of the helium fluid at various temperatures. Each stage of the cold finger comprises an internal regenerator and an internal expansion volume where the refrigeration occurs at the coldest end of each stage.

As a result of the development of these cryocoolers, small-scale (class S) liquefaction plants have become commercially available, however performance of these liquefiers is presently limited to less than 2 liters/day/kW. In these liquefiers, the gas to be liquefied does not undergo the complex thermodynamic cycles, but rather cools simply by thermal exchange with either the cold stages of the cryocooler, or with heat exchangers attached to the cold stages of the cryocooler. In these small-scale liquefiers, a cryocooler coldhead operates in the neck of a double-walled container, often called a Dewar, which contains only the gas to be liquefied and is thermally insulated to minimize the flow of heat from the outside to the inside of the container. After the gas condenses, the resulting liquid is stored inside the inner tank of the Dewar.

Ideally such small-scale liquefiers based on a cryocooler would achieve an efficiency comparable to that of the large and medium scale liquefiers. However, in practice, the achievable liquefaction performance in terms of liters per day per kW has been significantly less for these small-scale liquefiers than the performance realized by the larger Class M and Class L liquefaction plants. Accordingly, there is much room for improving the performance of small-scale liquefiers, and such improvements would be of particular benefit in the art.

SUMMARY OF EMBODIMENTS OF THE INVENTION

Technical Problem

Currently available small-scale liquefaction plants for producing less than 20 liters of liquefied cryogen per day, or "Class S" liquefiers, are substantially inefficient when compared to performances obtained by larger scale liquefaction plants. In addition, the medium and large scale plants involve substantial complexity, require extensive maintenance, and their liquefaction rates are far in excess of the needs of many users. In accordance with these limitations, a "Class S" liquefier which can achieve operating efficiencies greater than 2.0 liters/day/kW has not previously been available.

Solution & Advantages of the Invention Embodiments

It is a purpose of embodiments of this invention to provide a gas liquefaction system, and methods for liquefaction of gas therein, based on a cryocooler, that is adapted to utilize the thermodynamic properties of gaseous elements to extract increased cooling power from the cryocooler by operating at elevated pressures, and hence elevated liquefaction temperatures, wherein the increased cooling power of the cryocooler is utilized to improve the liquefaction rate and performance of the system.

To accomplish these improvements, the gas liquefaction system is adapted with a means for controlling pressure within a liquefaction region of the system such that an elevated pressure provides operation at increased liquefaction temperature as described above. By precisely controlling gas flowing into the system, an internal liquefaction pressure can be maintained at an elevated threshold. At the elevated pressure, just below the critical pressure, the increased cooling power of the coldhead is utilized.

The liquefaction region is herein defined as a volume within the Dewar including a first cooling region adjacent to a first stage of a cryocooler where gas entering the system is initially cooled, and a second condensation region adjacent to a second or subsequent stage of the cryocooler where the cooled gas is further condensed into a liquid-phase. Thus, for purposes of this invention, the liquefaction region includes the neck portion of the Dewar and extends to the storage portion where liquefied cryogen is stored.

In various embodiments of the invention, the means for controlling pressure can include a unitary pressure control module being adapted to regulate an input gas flow for entering the liquefaction region such that pressure within the liquefaction region is precisely maintained during a liquefaction process. Alternatively, a series of pressure control components selected from solenoid valves, a mass flow meter, pressure regulators, and other pressure control devices may be individually disposed at several locations of the system such that a collective grouping of the individualized components is adapted to provide control of an input gas entering into the liquefaction region of the system.

In certain embodiments of the invention, the liquefied gas element is helium. The helium gas is then liquefied at pressures close to 2.27 bar and at about 5.19 K to maximize the power available from the closed-cycle cryocooler. As indicative data, for a preferred embodiment of the invention, the system is capable of liquefying a mass of 19 kg of helium from 105,000 liters of helium gas under standard conditions into a container of 150 liter volume. This is attained with a liquefaction rate that exceeds 65 liters/day (or 260 g/hour) at 5.19 K, which is equivalent to 50 liters/day at 4.2 K, using a typical cryocooler that generates 1.5 W of cooling power at 4.2 K with a consumption of 7.5 kW of electrical power. The performance factor, R, is therefore >7 liters/day/kW, which is a significant improvement over currently available small-scale liquefiers. Naturally, as the efficiencies of the cryocoolers themselves continue to improve, so too will the performance of the gas liquefaction system described herein.

The aforementioned liquefaction improvements are achieved by a gas liquefaction system for liquefying gas comprising:

- a gas intake module adapted to be connected to a gas source and configured to provide gas to the system;
- a thermally isolated container;
- at least one interior tank in the container having at least one neck extending therefrom;
- at least one refrigeration coldhead having a cold finger portion located inside the neck and extending toward the interior tank;
- a gas compressor configured to provide compressed gas to the refrigeration coldhead for the operation of the cryocooler;
- at least one gas pressure control mechanism configured to dynamically adjust pressure and flow of the gas between the gas intake module and the interior tank; and
- at least one control device for controlling liquefaction performance of the system, said at least one gas pressure control mechanism and said at least one control device being configured to control pressure within the interior tank to achieve up to an optimal liquefaction performance by maintaining pressure inside the interior tank near a critical pressure of the gas being liquefied for providing liquefaction conditions capable of utilizing maximum cooling power of the refrigeration coldhead.

The system according to embodiments of the invention is adapted to maintain precise control over the vapor pressure inside the container, and thus is adapted to maintain precise control of the temperature and hence the power of the cryocooler where condensation is produced. Consequently, the system allows control of the operating point and power of the cryocooler, as determined by the temperatures of its one or more stages, and thereby the amount of heat that can be extracted from the gas, both for its pre-cooling from room temperature to the point of operation, and for its condensation and liquefaction.

Another aspect of the invention provides a gas liquefaction method that makes use of the gas liquefaction system disclosed in the present application which comprises the following steps:

- supplying gas to the gas liquefaction system through the gas intake module;
- regulating the power of the refrigeration coldhead by means of the control devices to achieve a desired rate of liquefaction;
- adjusting the flow of gas entering the interior tank by means of the gas pressure control mechanism and the control devices for achieving a constant pressure within the interior tank; for a period of time during which liquefaction is performed, maintaining the pressure within the interior tank at a liquefaction pressure above atmospheric pressure and up to the critical pressure of the gas being liquefied by means of the gas pressure control mechanism and the control devices; and
- dynamically modulating the power of the refrigeration coldhead, the flow of gas entering the interior tank and the pressure within the interior tank by the control device to achieve desired liquefaction performance.

In another embodiment, a method for achieving high-performance liquefaction of cryogen gas within a liquefier comprises:

- using a computer control device coupled to one or more pressure regulators, electronically controlled valves, one or more mass flow meters and one or more pressure sensors:
- monitoring pressure within a liquefaction region of the liquefier; and
- dynamically adjusting a flow of gas entering the liquefaction region of the liquefier to achieve a constant liquefaction pressure therein;
- wherein said constant liquefaction pressure is greater than 1.00 bar.

Thus, the gas liquefaction system described in the embodiments herein achieves much higher efficiencies than existing cryocooler-based liquefiers by performing the gas liquefaction at a higher pressure and therefore a higher temperature, where the cryocooler has much greater cooling power to perform the liquefaction and the cryogen being liquefied has a much lower heat of condensation. The liquefaction efficiency of the system is further enhanced and stabilized by precisely controlling the flow rate of the room temperature gas entering the liquefaction region, and thereby precisely controlling the pressure of the condensing gas in the liquefaction region of the system. The two-fold effect of higher cryocooler power and lower heat of condensation at the higher condensation pressure, further enhanced by the precise pressure control, allows this new gas liquefaction process to achieve much higher rates of liquefaction with less input power to the cryocooler than is presently available from other cryocooler-based liquefiers.

BRIEF DESCRIPTION OF DRAWING

The characteristics and advantages of this invention will be more apparent from the following detailed description, when read in conjunction with the accompanying drawing, in which.

DETAILED DESCRIPTION OF EMBODIMENTS OF THE INVENTION

Figure 1:
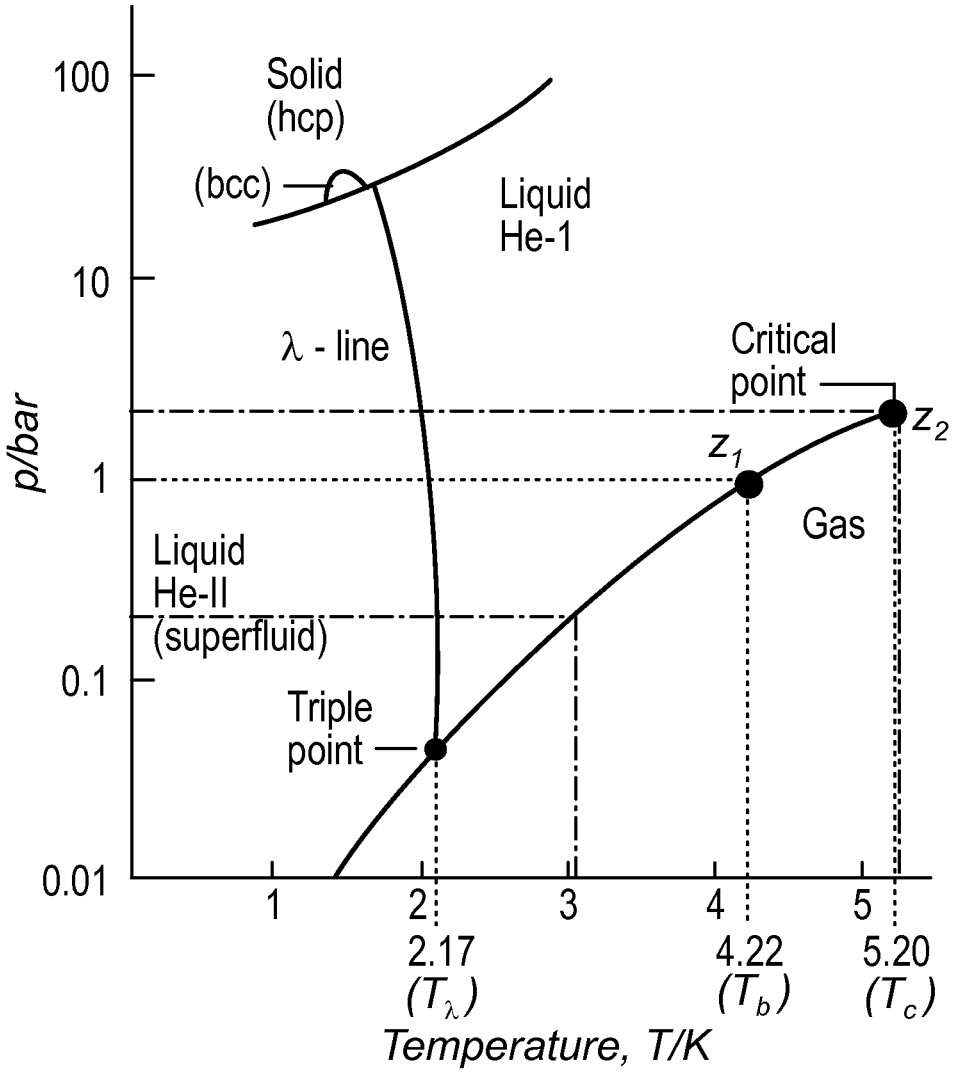
FIG. 1 is a phase diagram of helium 4.

In the following description, for purposes of explanation and not limitation, details and descriptions are set forth in order to provide a thorough understanding of the present invention. However, it will be apparent to those skilled in the art that the present invention may be practiced in other embodiments that depart from these details and descriptions without departing from the spirit and scope of the invention. Certain embodiments will be described below with reference to the drawings wherein illustrative features are denoted by reference numerals.

In a general embodiment of the invention, a liquefaction system, also referred to herein as a cryostat, includes an isolated storage container or Dewar comprising a storage portion and a neck portion extending therefrom and connected to an outer vessel which is at ambient temperature. The Dewar is insulated by a shell with the volume within the shell external of the storage portion being substantially evacuated of air. The neck portion is adapted to at least partially receive a cryocooler coldhead. The coldhead may comprise one or more stages, each having a distinct cross section. The neck portion of the isolated container may be optionally adapted to geometrically conform to one or more stages of the coldhead cryocooler in a stepwise manner. The isolated container further comprises a transfer port extending from the storage portion to an upper surface of the Dewar. A control mechanism is further provided for controlling gas flow and, thereby, pressure within a liquefaction region of the Dewar. The control mechanism generally includes: a pressure sensor for detecting pressure within the liquefaction region of the cryostat; a pressure regulator or other means for regulating pressure of gas entering the liquefaction region of the Dewar; a mass flow meter; and one or more valves for regulating input gas flow entering the liquefaction region. In this regard, the control mechanism is further connected to a computer for dynamically modulating input gas flow, and hence, pressure within the liquefaction region of the cryostat for yielding optimum efficiency.

Although not illustrated, it should be noted that the cryostat may comprise one or more storage portions and one or more neck portions extending therefrom within the isolated container.

In one embodiment of the invention, the refrigeration coldhead of the gas liquefaction system is routed toward the interior tank of the container and comprises at least one stage defining a refrigeration stage.

In another embodiment of the invention, the cryocooler coldhead comprises a cylinder that routes toward the interior tank of the container consisting of a first stage and a second stage, both parallel-oriented to the neck of the container, and that collectively define two refrigeration stages.

In yet another embodiment, the cryocooler coldhead routed toward the interior tank of the container comprises three or more stages collectively defining three or more refrigeration stages.

For these embodiments of the invention, the coldhead comprising one or more stages of the refrigeration system operates in the neck of a thermally isolated container or Dewar. The first stage is the warmest and operates in the neck further from the liquefaction region than the other stages that operate in the neck closer to the liquefaction region. The gas enters at the warm end of the neck and is pre-cooled by the walls of the first stage of the coldhead, by the coldest end of the first stage, further precooled by the walls of the colder stages, and is then condensed at the coldest end of the coldest stage of the coldhead. (For the one-stage embodiment, the condensation occurs at the coldest end of the first stage.) Once condensed or liquefied, the liquid falls to the bottom of the tank, or storage portion, located in the interior of the isolated container. The cooling power that each stage of a closed-cycle cryocooler generates is determined mainly by its temperature, but also depends to second order on the temperature of the previous stages. This information is generally supplied by the cryocooler manufacturer as a two dimensional load map that plots the dependence of the power of the first and second stages versus the temperatures of the first and second stages. Of importance to this invention is that the cooling power available at each stage generally increases with temperature.

In addition to generating cooling power at the first and subsequent stages, the coldhead also generates cooling power along its entire length, in particular along the surface of the cylindrical cold finger between room temperature and the coldest end of the first stage, and along the length of the cylindrical cold finger between the first and subsequent stages. It is an object of this invention to optimize the heat exchange between the gas and the various cooling stages, as well as between the gas and the walls of the cylindrical cold finger between the various cooling stages of the cryocooler coldhead. This is achieved by using the high thermal conductivity properties of the gas without the need for mechanical heat exchangers or condensers of any kind that attach to the coldhead, or any radiation screens in the neck, which have generally been considered as essential in previous state-of-the-art systems. Therefore, it is also an object of this invention to extract as much heat from the gas as possible at the highest possible temperature by optimizing the heat transfer between the gas and walls of the cylindrical cold finger between the various cooling stages. This will also reduce the thermal load on the various cooling stages of the cryocooler coldhead, thereby optimizing the thermal efficiency of the precooling and liquefaction process.

Generally, a multi-stage coldhead is constructed with the upper or first stage having a larger diameter than the lower stages of the coldhead. In this regard, the stages of the cryocooler coldhead are manufactured in a step pattern where the two or more stages have different cross sections. The neck portion of the isolated container can be adapted in various embodiments for receiving the one or more stages of the cryocooler coldhead.

In one embodiment, the neck portion of the isolated container can include an inner surface adapted to closely match the surface of the one or more stages of the cryocooler coldhead, such that the neck portion comprises a first inner diameter at the first stage and a second inner diameter at the second stage, wherein the first inner diameter is distinct from the second inner diameter. The narrowed volume reduces the heat load down the neck, while the stepped neck improves the exchange process between the gas and the cryocooler, favoring natural convection in the stepped area, at least during the initial cooldown.

Alternatively, the neck portion can be adapted with a uniform inner diameter extending along a length of the neck portion adjacent to the one or more stages of the cryocooler coldhead. When a straight neck is used, the exchange process is still efficient for initial cooldown and liquefaction. Thus, the present invention can make use of straight or stepped necks inside the container.

In one embodiment of the invention, the gas pressure control mechanism comprises one or more of the following elements:

- one or more pressure regulators adapted to regulate the pressure of the gas flowing from the gas intake module;
- one or more mass flow meters configured to measure a volume of the gas from the pressure regulators; one or more electronically controlled valves;
- one or more pressure sensors;
- means for coupling said pressure regulators, mass flow meters, valves, and pressure sensors to said control device; and
- means for coupling signals from said at least one control device to dynamically configure said pressure regulators, mass flow meters, valves, and pressure sensors to enable said gas pressure control mechanism to adjust pressure of the gas entering the interior tank.

According to this embodiment of the invention, a system of pipes or tubing, valves (manually or electronically controlled), and control mechanisms enables the manipulation of both the pressure and mass flow rate of the gas as it enters the Dewar. The intake gas pressure may differ from the pressure of gas present within the Dewar, or the pressure in the Dewar may need to be adjusted to achieve optimal performance. To avoid rapid pressure changes that greatly disturb equilibrium conditions, the system integrates the aforementioned gas-pressure control mechanisms by means of, for instance, a solenoid valve and a pressure control mechanism. This process regulates the intake pressure as deemed necessary to control the flow of gas from the gas-intake mechanisms to the Dewar.

Additionally, the system of this invention achieves its precision pressure control through the use of control-mechanisms that regulate the cooling power of the cryocooler's coldhead by adjusting the valves and the mass flow of the gas.

Furthermore, the control mechanisms receive the necessary data from the system to calculate the level of liquid inside the container, which is needed to perform the necessary adjustments. Additionally, the liquefying processes can be performed under varying pressure ranges starting at slightly above atmospheric pressures and reaching near-critical gas pressure values. All functions and procedures are controllable remotely or in situ, using programmable devices such as personal computers or an FPGA (Field Programmable Gate Array), with specific control software (such as LabView-based applications), or connected to digital storage hardware in which such software is stored and remotely accessed.

In another embodiment of the invention, the liquefaction system comprises a transfer port and valve located at the top of the isolated container that allows the extraction of the liquid, resulting from liquefied gas present in the storage portion within the interior tank.

In one embodiment of the invention, the gas liquefaction method comprises the determination of the level of liquefied gas inside the storage portion of the interior tank from the total mass of the gas contained in the interior tank and the gas and liquid densities determined by measurement of the pressure or temperature at thermodynamic equilibrium. The gas level can be calculated based upon an algorithm involving the mass flow rate, the integrated mass flow rate, the total volume of the inner tank of the container, and the densities of the gas and liquid as determined by the pressure and temperature inside the container.

In another embodiment of the invention, the gas liquefaction method includes a cleaning mode comprising the steps of:

- triggering the input valve to close, preventing the flow of gas into the gas liquefaction system;
- determining and maintaining the pressure of the isolated container; and
- performing on/off cycles of the refrigeration coldhead, forcing the temperatures of the cryocooler stages to exceed temperatures of fusion and sublimation of impurities present in the interior of the isolated container, making such impurities precipitate and fall into the bottom of the interior tank and thus cleansing the zone where the gas is pre-cooled and liquefied.

In still another embodiment, the gas liquefaction method includes a stand-by mode, in which the volume of liquefied gas is indefinitely conserved in equilibrium with the vapor, initiated by the control devices, triggering of the intake valve by means of the gas pressure control mechanisms to close the gas intake into the system and obtaining the necessary reduced power by performing start/stop cycles of the coldhead or through the speed control of the coldhead of the cryocooler.

By the above stand-by mode performing start/stop cycles and cleaning mode, through automatic manipulation of the intake-control mechanisms, one can halt gas liquefaction and maintain the liquid volume constant in the interior tank. The start/stop cycles of the cryocooler coldhead produce temperature cycles in the coldhead that permit the fusion and subsequent precipitation of impurities acquired at the stepped cylinder of the aforementioned coldhead.

In yet another embodiment, the gas liquefaction method enables direct liquefaction of recovered gas at or slightly above atmospheric pressure, the method comprising:

storing gas in the buffer storage tank at or slightly above atmospheric pressure; and maintaining the system at or near atmospheric pressure by means of the gas pressure control mechanisms for optimizing liquefaction.

For the case of helium, when the vapor pressure in the Dewar is in equilibrium with the liquid, the temperature of gaseous and liquid helium is solely defined by the equilibrium vapor-pressure curve. Of significance to this invention is that the temperature of helium increases with pressure along the vapor-pressure curve. In the case of helium, both pressure and temperature increase from the triple point of helium (at an absolute pressure of 0.051 bar and a temperature of 2.17 K) to the critical point of helium, which occurs at the critical pressure, $P_c$, of 2.27 bar absolute and critical temperature, $T_c$, of 5.19 K. Normally with no applied load, the lowest temperature reached by closed cycle cryocoolers is about 3 K for which the vapor pressure of helium is about 0.5 bar. Therefore, a practical range over which the capabilities of closed-cycle cryocooler systems and the helium vapor-pressure curve overlap is from about 0.5 bar at 3 K to 2.27 bar at 5.19 K. Accordingly, the refrigeration system can also perform at the intermediate point at atmospheric pressure and at a temperature of 4.23 K.

In another embodiment of the gas liquefaction method of the present invention, the gas pressure control mechanisms, the gas intake module, and the control devices are governed by means of a software program in at least one digital data storage means.

In another embodiment, the digital data storage means is connected to a programmable device in charge of executing the software program.

In another general embodiment, a method for liquefaction of gas is provided in conjunction with the described systems. The method comprises:

(i) providing at least: a source containing an amount of gas-phase cryogen; a Dewar having a liquefaction region defined by a storage portion and a neck portion extending therefrom; a cryocooler at least partially disposed within the neck portion, the cryocooler being adapted to condense cryogen contained within the liquefaction region from a gas-phase to a liquid phase; and a pressure control mechanism, the pressure control mechanism comprising at least a pressure sensor, a mass flow meter, and one or more valves;

(ii) measuring vapor pressure within said liquefaction region of said Dewar using said pressure sensor;

(iii) maintaining said vapor pressure within said liquefaction region within an operating range by dynamically controlling an input gas flow about the liquefaction region; and (iv) regulating the input gas flow about the liquefaction region using the pressure control mechanism.

In certain embodiments, the method may further comprise the step of processing data on a computer for said dynamic control of said cryostat, wherein said data includes at least one of: said measured vapor pressure, and a rate of said input gas flow.

Although helium is extensively discussed in the representative embodiments, it should be recognized that other cryogens may be utilized in a similar manner including, without limitation: nitrogen, oxygen, hydrogen, neon, and other cryogenic gases.

Furthermore, it should be recognized that although depicted as a distinct unit in several descriptive embodiments herein, the components of the control mechanism can be individually located near other system components and adapted to effectuate a similar liquefaction process. For example, the pressure regulator can be attached to the gas storage source or otherwise positioned anywhere between the storage source and liquefaction region of the cryostat system. Alternatively, the source can be fitted with a compressor for supplying an input gas at a desired pressure. Such a system would not necessarily require a pressure regulator within the pressure control mechanism. It should be recognized that various modified configurations of the described system can be achieved such that similar results may be obtained. Accordingly, the pressure control mechanism is intended to include a collection of components in direct attachment or otherwise collectively provided within the system for dynamically controlling input gas flow, and thus pressure within the liquefaction region of the cryostat.

Now turning to the drawings, FIG. 1 illustrates a general phase diagram of helium 4. The range of operation for general closed cycle cryocooler coldheads is between about 3.0 K and about 5.2 K and between about 0.25 bar and about 2.27 bar. In reference to the liquefaction curve of FIG. 1, $Z_1$ represents a point at which helium gas is liquefied at atmosphere, and the liquefaction temperature is about 4.2 K, as is the current state of the art for small scale liquefiers. $Z_2$ represents a point on the liquefaction curve at which helium gas is liquefied just below the critical point where the liquid and gas are in equilibrium. The pressure at $Z_2$ is near the critical pressure Pc (here about 2.2 bar), and the liquefaction temperature at $Z_2$ is about 5.2 K. It is at this point ($Z_2$) where the present liquefaction system is intended to operate and is preferably operated during a typical helium gas liquefaction process.

The optimal liquefaction pressure is slightly below the critical pressure, that is, 2.1 bar for the case of helium, a pressure for which rates can reach and surpass 65 liters/day at 2.1 bar (260 g/h), equivalent to 50 liters/day at 1 bar, with efficiencies equal to or even greater than 7 liters/day/kW. In some embodiments, the optimal liquefaction pressure is greater than 1.00 bar and no more than 2.27 bar.

Figure 2:
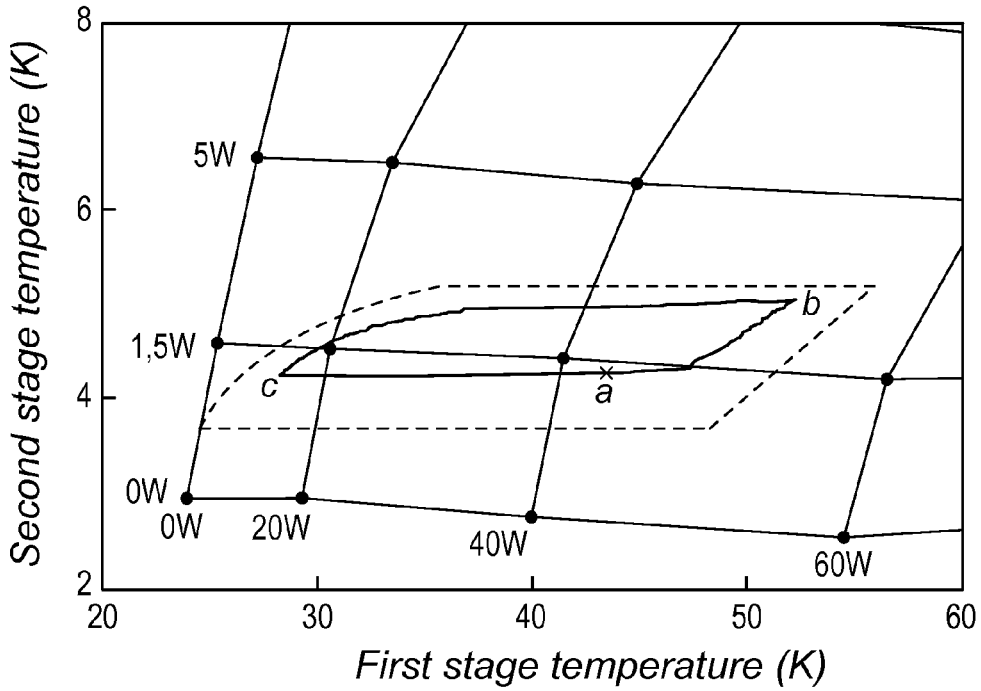
FIG. 2 is the load map for a typical cryocooler having 2 stages, which shows the cooling power of both the first and second stages of the cryocooler at various temperatures, as well as several operating points (a, b and c) of the coldhead during a trajectory characteristic of a typical liquefaction cycle of this liquefaction system.

FIG. 2 represents a load map, which defines the characteristics of a typical cryocooler coldhead 18 (see FIG. 3) operating at 50 Hz and using 7.5 kW of power. The load map defines the unique relationship between a set of paired points (T.sub.1, T.sub.2) and (P.sub.1, P.sub.2), where T.sub.1 is the temperature of the coldest end of the first stage, T.sub.2 is the temperature of die coldest end of the second stage, P.sub.1 is the power of first stage 10, and P.sub.2 is the power of second stage 11. The measured point (0 W, 0 W) maps to the point (3 K, 24 K), which indicates that the lowest temperatures achieved with no load applied to either of the two stages of this cryocooler are about 3 K on the second stage and 24 K on the first stage. The measured point (5 W, 40 W) maps to the point (6.2 K, 45 K) and shows that if 5 W of power is applied to the second stage and 40 W of power is applied to the first stage, then the second stage will operate at about 6.2 K and the first stage at about 45 K. The measured load map points are connected by lines to interpolate intermediate points.

An efficient helium gas liquefaction cycle is also shown on the load map as the continuous line cycle connecting points (a), (b), and (c). The points are determined by the temperature (or pressure) of the helium and are plotted versus the temperature $T_2$ of the second stage. Point (a) is at a temperature ($T_2$) of about 4.3 K, which corresponds to a pressure of about 1.08 bar, which is slightly above atmospheric pressure at 1.0 bar. At point (a) the liquefaction rate is about 20 liters/day. Point (b) is close to the critical point and is at a temperature $T_2$ of 5.1 K, which corresponds to a pressure of 2.1 bar. Point (b) is where the maximum liquefaction efficiency occurs and normally the system is maintained at point (b) until the volume of the interior tank is completely filled with liquid helium. At point (b), the liquefaction rate is about 65 liters/day (260 g/hr), which is equivalent to 50 liters/day at 1.0 bar. The trajectory shown joining point (a) to point (b) is one the most efficient paths to follow between these two points while maintaining quasi-equilibrium conditions.

Point (c) is at about 4.2 K ($T_2$) at atmospheric pressure, the pressure that the system is normally returned to before transferring liquid out of the Dewar and into scientific or medical equipment. The trajectory shown joining point (b) and point (c) is one of the most efficient trajectories taken between these two points. Not only is the pressure being decreased in the interior tank, but since the density of liquid increases between these two points, the volume of the liquid contracts and therefore liquefaction must continue along this trajectory to keep the interior tank filled with liquid when it reaches point (c).

The gas liquefaction system can also operate over a much wider range than the trajectory defined by points (a), (b), and (c). An example of the total working area of the liquefier is depicted as an area enclosed by dashed lines in FIG. 2. The lower left region of this working area includes the liquefaction of helium gas for pressures less than 1 atmosphere, where $T_2$, the temperature of the coldest end of the second stage, is under 4.2K and the liquefaction rates in turn are about 17 liters/day. This region is appropriate for MRI equipment and other equipment that must operate under these conditions. At the upper right region of the working area, it is shown that the liquefier can operate above the critical point, where it fills the interior tank only with dense helium gas. Other efficient trajectories include, for example, the case where point (c) matches point (a), defining a closed cycle comprised by the trajectory points (a), (b), (a).

Figure 3:
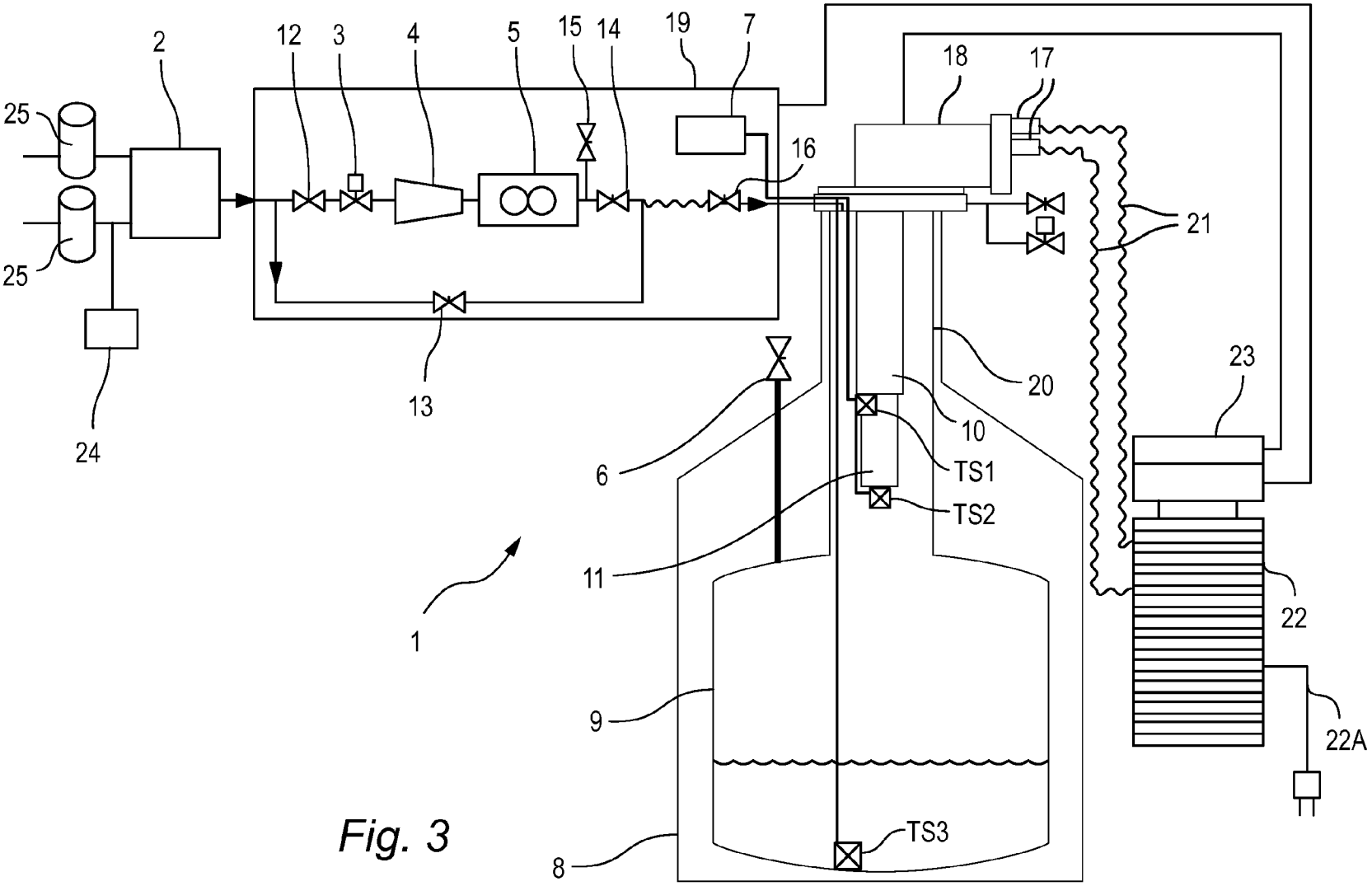
FIG. 3 is a schematic diagram of the system and its composite elements according to at least one embodiment of the invention.

FIG. 3 illustrates a schematic of the general gas liquefaction system 1 according to various embodiments of the invention. The system is supplied primarily with gas through gas intake module 2, preferably with recovered gas, of 99% purity or higher in the case of helium, although it can operate with lower purity grades if necessary. The system of FIG. 3 illustrates two helium gas sources 25, a first source is directly connected to the gas intake module, and a second source further comprises buffer storage tank 24 for operation with sensitive MRI and other equipment. The gas is liquefied in interior tank 9 of thermally isolated vacuum flask or container 8, such as a Dewar or a thermos container. The liquefaction process comprises controlling the gas pressure in the interior tank, while the gas is cooled and condensed by one or more cryocooler coldheads 18 comprised of closed-cycle cryocoolers of one or more stages, placed in one or more necks 20 of the interior tank of the isolated container.

Although in principle the present invention allows the use of any multi-stage cryocooler, the following description is directed to an embodiment comprising a coldhead with two refrigeration stages. Nonetheless, it should be apparent to the person skilled in the art that the application to other types of coldheads (equipped with one, two, or more refrigeration stages) is analogously achievable with equivalent increase in the liquefaction rates.

In FIG. 3, cryocooler coldhead 18 has two cold stages defined by a step pattern, with the cylindrical diameter of first stage 10 being larger than the diameter of second stage 11. In the case of helium, the high thermal conductivity of the gas and the convection currents generated by thermal gradients in the direction of the gravity force provides extremely efficient heat exchange between the two stages of the coldhead and the gas, and eliminates the need for mechanical heat exchangers, condensers, and radiation screens. Convection currents are of importance only during the first cool down, since after the bottom of interior tank 9 becomes cooled, helium is stratified in temperature and the gradient is always opposite to the gravity force. Temperature sensors are used to measure the vapor temperature $T_{S1}$ at the lower end of first stage 10, the vapor temperature $T_{S2}$ at the lower end of second stage 11, and the vapor or liquid temperature $T_{S3}$ at the bottom of interior tank 9. After condensing, the liquid descends into and fills the storage portion of the interior tank. The liquid is transferred out of the interior tank, either manually or automatically, via transfer valve or port 6 when needed. Means of connection 17 on the coldhead are used to connect to refrigeration compressor 22, via which compressed gas is supplied to and returned from coldhead 18 via compressor hoses 21 and electrical power via compressor power cable 22A.

Gas pressure control mechanism 19 maintains control over the input flow of the gas to control the pressure inside interior tank 9. The gas pressure control mechanism measures the pressure of the interior tank using pressure sensor 7 and controls the flow rate of the gas going to the container using input valve 3 (preferably a solenoid valve), pressure regulator 4, and various flow-control input valves, preferably electronic solenoid valves or manual valves 12, 13, 14, 15, 16. Gas mass flow meter 5 measures the instantaneous flow rate, which is modulated by gas pressure regulator 4 as it controls the pressure. The integrated gas flow, pressure, and temperature are used to calculate the total amount of gas as well as the level of liquid accumulated within the interior tank of isolated container 9. Gas pressure control mechanism 19 can halt the gas input if the pressure of the helium supply is insufficient, and can switch the system into stand-by mode to maintain the mass of the liquefied gas. The mass flow of the gas going to the isolated container, and consequently the liquefaction rate, will increase as the power available for condensation on last stage 11 of coldhead 18 of the cryocooler increases. Since helium is stratified with the same temperature profile as the coldhead, thermal exchange between the gas and the coldhead is optimal.

Computer control device 23, comprising at least a computer equipped with programmed software/hardware and a monitor, controls the performance of the system by means of gas pressure control mechanism 19, refrigeration coldhead 18, cryocooler compressor 22, temperature sensors, and optional level indicators inside the interior tank.

The liquefaction process comprises introducing into interior tank 9 the mass of gas equivalent to 100% of its volume and maintaining it as close as possible to atmospheric pressure or to the pressure of the chosen application for the liquid in the shortest possible time. To achieve this, the maximum power must be extracted from the gas by the coldhead of the cryocooler 18 during the entire process. This is to say, the trajectory that the process describes on the cryocooler coldhead load map is ideally the most efficient one.

In another embodiment of the invention, gas liquefaction system 1 is configured for the recovery of helium in MRI machines. For added security, the gas recovery system may include an additional manual safety valve that is located between the MRI machine and small buffer storage tank 24, preferably metallic, which is placed immediately before the entry of gases. The function of such a buffer storage tank or external container is to establish a small gas reserve in which the pressure can be adjusted to perform at or near atmospheric pressures, always within the specific range of the MR1 machines. Additionally, vertical access port 6 can be located on one of the sides of the top part of the Dewar for transferring the liquid helium from the liquefier to the scientific or medical MRI equipment. This can either be configured to insert a simple transfer tube, or it may be configured with a cryogenic valve.

The condensation process of the cold vapor accumulating as liquid in interior tank 9 corresponds to an isobaric process during which any disturbance in pressure yields a diminished liquefaction rate. For gas liquefaction system 1 to perform at optimum efficiency, it is therefore necessary to perform precise pressure control of interior tank 9 using electronic control of the diverse gas pressure control mechanism 19, and maintain the control throughout the entire process.

It has been observed that the highest liquefaction rates can only be obtained with a gas purity of 99.99% or better, while lower purity gas significantly degrades the liquefaction performance. In addition, after contamination with impure gas, the system shows no improvement in the liquefaction rate when the input gas is returned to 99.99% purity or better. However, the standby mode can also be used to clean the surfaces of the coldhead and to restore efficiency. When the temperatures of the first stage and the second stage are set high enough to produce fusion and sublimation of any impurities, the system undergoes a process of regeneration, or cleaning, without loss of gas. After a set of several such standby-mode cycles, the liquefaction rate increases again to values characteristic of liquefying high purity gas. During liquid transfer operations, the same purge or regeneration effect is reproduced, due to the temperature increase (over 100 K) of both the first stage and the second stage of the refrigeration coldhead.

Figure 4:
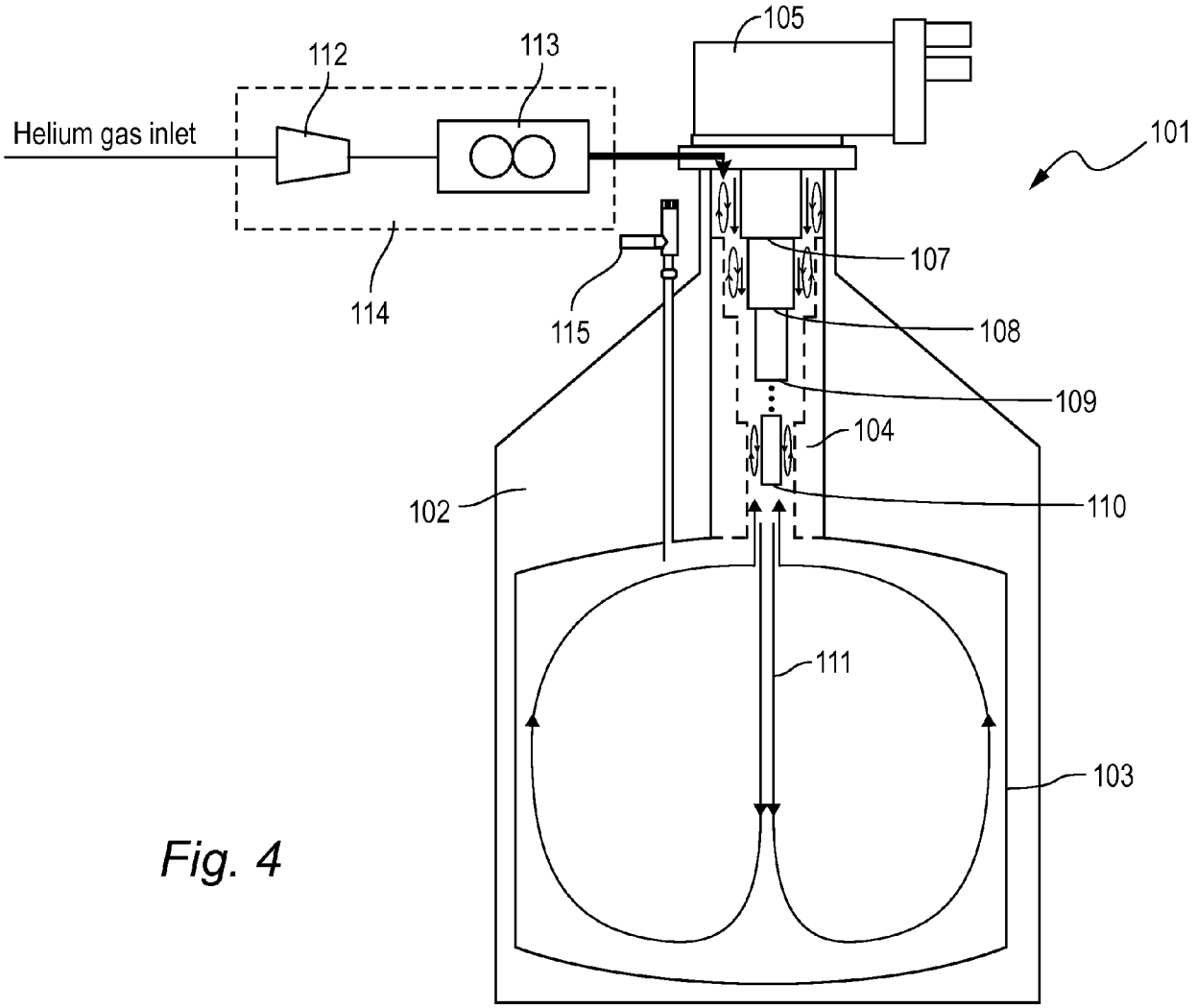
FIG. 4 is a general schematic of a portion of the system for improved liquefaction of cryogen gas of FIG. 3, further illustrating convection paths about a liquefaction region of the system.
Figure 5:
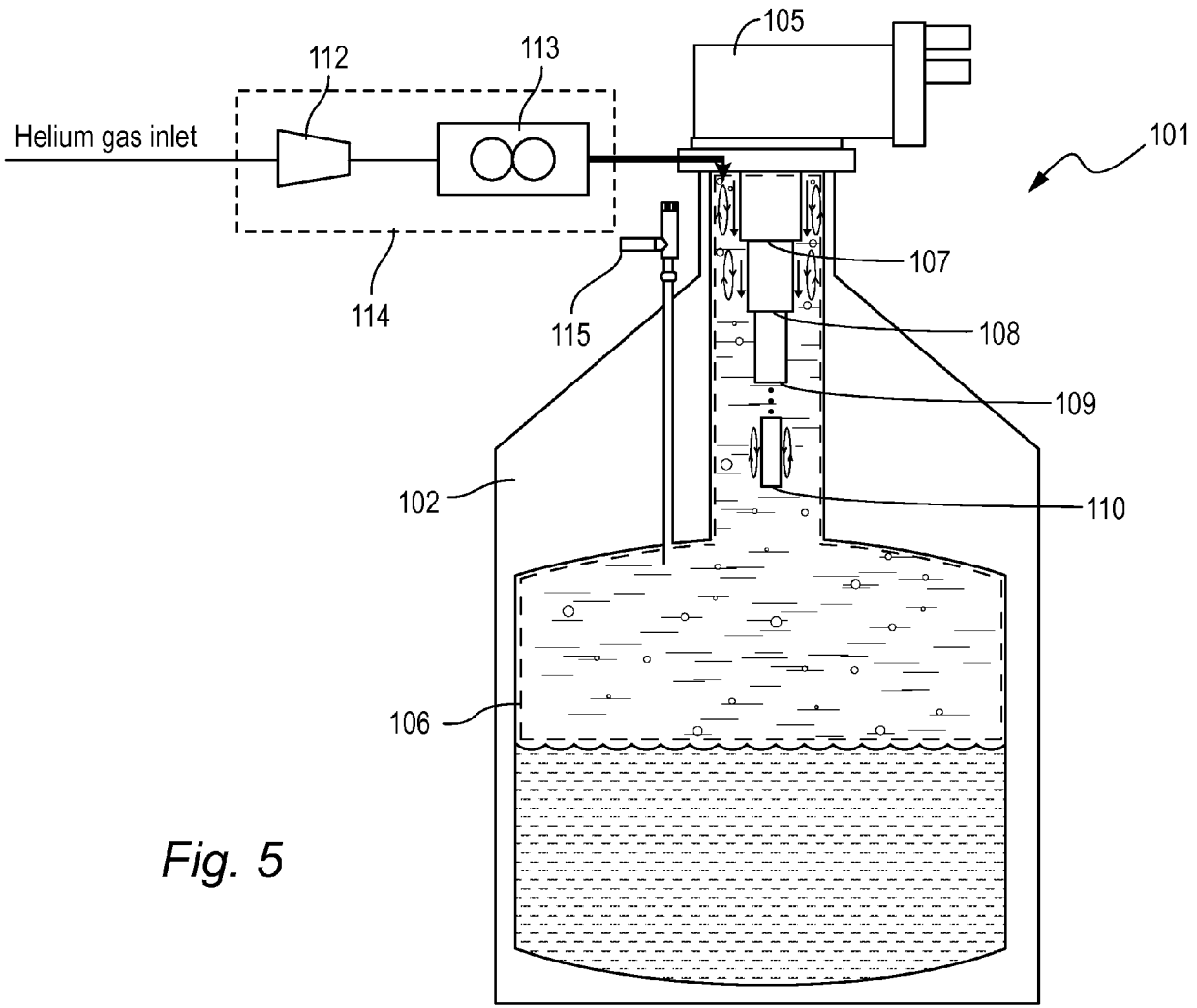
FIG. 5 is a schematic of the system according to FIG. 4, further depicting a dashed area within the system being referred to herein as a liquefaction region.

FIGS. 4 and 5 further illustrate a system for liquefaction of cryogen according to various embodiments of the invention. System 101 includes vacuum isolated container 102 having storage portion or tank 103 and neck portion 104 extending from the storage portion, a coldhead cryocooler 105 at least partially received within the neck portion, and liquefaction region 106 defined by a volume of space generally disposed between the storage portion and neck portion adjacent to the coldhead as is further depicted by the dashed area of FIG. 5. The coldhead includes N coldhead stages represented as first stage 107, second stage 108, third stage 109, and Nth stage 110. In the system of FIG. 5, the neck portion is a straight neck. However as noted by dashed lines in FIG. 4, the neck can optionally be adapted to geometrically conform to the surface of the coldhead stages. Cooling gas convection paths 111 are further depicted in FIG. 4. The system is adapted for improved liquefaction of cryogen by controlling pressure within the liquefaction region of the cryostat. Pressure control mechanism 114 includes electronic pressure controller 112 and mass flow meter 113 for controlling input gas flowing into the cryostat such that pressure within the liquefaction region is optimized for improved liquefaction. Extraction port 115 provides access to the liquefied cryogen.

In certain embodiments of the invention, a method for improved liquefaction of cryogen, such as helium, includes:

providing a cryostat including a vacuum isolated container having a storage portion and at least one neck portion extending therefrom, a coldhead cryocooler at least partially received within the neck portion, and a liquefaction region defined by a volume of space disposed between the storage portion and neck portion adjacent to the coldhead;

providing a pressure control mechanism for maintaining a desired pressure about the liquefaction region of the cryostat, wherein the desired pressure is substantially uniform about the liquefaction region; and controlling pressure within the liquefaction region during a liquefaction process such that the liquefaction of cryogen can be accomplished at slightly higher temperatures where the cryocooler is configured to operate at an increased cooling power.

In another embodiment, a method for achieving high-performance liquefaction of cryogen gas within a liquefier comprises:

using a computer control device coupled to one or more pressure regulators, electronically controlled valves, one or more mass flow meters and one or more pressure sensors:

monitoring pressure within a liquefaction region of the liquefier; and dynamically adjusting a flow of gas entering the liquefaction region of the liquefier to achieve a constant liquefaction pressure therein;

wherein said constant liquefaction pressure is greater than 1.00 bar.

In another embodiment, the method may further comprise:

using the computer control device:

controlling power of a cryocooler being at least partially disposed within the liquefaction region for achieving a desired liquefaction rate;

wherein the power of the cryocooler, the flow of gas entering the liquefaction region, and the pressure within the liquefaction region are each dynamically modulated by the computer control device to achieve desired liquefaction performance.

The invention claimed is:

1. A gas liquefaction system for liquefying helium gas, comprising:

a gas intake module adapted to be connected to a gas source external to the system, said module being configured to provide helium gas at room temperature to the system;

a thermally isolated container;

at least one interior tank in the container having an interior and at least one neck extending therefrom and having an upper end spaced from and in direct communication with said interior of the tank;

at least one refrigeration coldhead having a cold finger portion extending from said upper end of said at least one neck at room temperature inside the neck and an end of said cold finger closest to the interior of the tank being at gas liquefying temperature extending toward the interior of the tank;

a gas compressor connected to provide compressed gas to the refrigeration coldhead for the operation of the cryocooler;

at least one gas pressure control mechanism configured to dynamically adjust pressure and flow of the gas between the gas intake module and the interior tank;

at least one control device for controlling liquefaction performance of the system, said at least one gas pressure control mechanism and said at least one control device being configured to control pressure within the interior tank to achieve a predetermined liquefaction performance greater than 2.0 liters/day/kW by maintaining constant the pressure inside the interior tank during liquefaction at a high value of at least 1.0 bar but not above the critical pressure of helium gas being liquefied for providing liquefaction conditions capable of utilizing maximum cooling power of the refrigeration coldhead; and an extraction port in communication with an ambient environment and configured to enable liquefied helium to be removable from the system;

a serial, open-ended flowpath being defined through the gas liquefaction system from the gas intake module to the extraction port.

2. The gas liquefaction system of claim 1, wherein the gas pressure control mechanism comprises:

one or more pressure regulators adapted to regulate the pressure of the gas flowing from the gas intake module;

one or more mass flow meters configured to measure a volume of the gas from the pressure regulators;

one or more electronically controlled valves;

one or more pressure sensors;

means for coupling said pressure regulators, mass flow meters, valves, and pressure sensors to said control device; and means for coupling signals from said at least one control device to dynamically configure said pressure regulators, mass flow meters, valves, and pressure sensors to enable said gas pressure control mechanism to adjust pressure of the gas entering the interior tank.

3. The gas liquefaction system of claim 1, further comprising one or more mechanical valves configured to control the passage of gas through the gas pressure control mechanism.

4. The gas liquefaction system of claim 1, wherein the at least one control device provides reduced pressure within the interior tank from said liquefaction pressure high value down to about atmospheric pressure.

5. A gas liquefaction method that makes use of gas liquefaction system according to claim 1, the method comprising:

supplying helium gas to the gas liquefaction system through the gas intake module;

regulating the power of the refrigeration coldhead by means of the control devices to achieve a predetermined rate of liquefaction with a liquefaction performance greater than 2.0 liters/day/kW;

adjusting the flow of gas entering the interior tank by means of the gas pressure control mechanism and the control devices for achieving a constant pressure within the interior tank;

for a period of time during which liquefaction is performed, maintaining the pressure within the interior tank at a liquefaction pressure of at least 1.0 bar but not above the critical pressure of the helium gas being liquefied by means of the gas pressure control mechanism and the control devices;

dynamically modulating the power of the refrigeration coldhead, the flow of gas entering the interior tank and the pressure within the interior tank by the control device to achieve the predetermined rate of liquefaction performance and filling the interior tank with liquefied gas.

6. The gas liquefaction method according to claim 5, and further comprising determining the level of liquefied gas inside the interior tank at the liquefaction pressure from the total mass of the gas in the interior tank and/or the determination of the gas and liquid densities by measuring the pressure or temperature at thermodynamic equilibrium.

7. The gas liquefaction method according to claim 5, and further comprising:

triggering an input valve to close, preventing the flow of gas into the system;

determining and maintaining the pressure in the interior tank between atmospheric pressure and the liquefaction pressure; and performing on/off cycles of the refrigeration coldhead, forcing the temperatures of refrigeration coldhead stages to exceed temperatures of fusion and sublimation of impurities present in the interior tank and thus cleansing the zone where the gas is pre-cooled and liquefied; and maintaining unchanged the level and temperature of the liquid in the interior tank.

8. The gas liquefaction method according to claim 5, including direct liquefaction of recovered gas above atmospheric pressure, comprising:

storing gas in a buffer storage tank prior to its passage through the gas intake module above atmospheric pressure; and maintaining the gas liquefaction system at any pressure above atmospheric pressure but not above the liquefaction pressure by means of the gas pressure control mechanism.

9. The gas liquefaction method according to claim 5, wherein the gas pressure control mechanism, the gas intake module, and the control devices are governed by means of a software program in at least one data storage means.

10. The gas liquefaction method according to claim 9, wherein the data storage means is connected to a programmable device in charge of executing said software program.

11. The gas liquefaction method according to claim 5, and further comprising reducing the pressure within the interior tank to about atmospheric pressure.

12. A method for achieving high-performance liquefaction of cryogen gas within a liquefier, a method comprising:

using a computer control device coupled to one or more pressure regulators, electronically controlled valves, one or more mass flow meters and one or more pressure sensors;

monitoring pressure within a liquefaction region of the liquefier;

dynamically adjusting a flow of externally supplied, room temperature gas entering the liquefaction region of the liquefier to achieve a constant liquefaction pressure therein; and maintaining constant the liquefaction pressure at a level of at least 1.0 bar but not above the critical pressure of the helium gas during liquefaction of the helium gas.

13. The method of claim 12, further comprising:

using said computer control device to control power of a cryocooler being at least partially disposed within said liquefaction region for achieving a predetermined liquefaction rate with a liquefaction performance greater than 2.0 liters/day/kW.

14. The method of claim 13, wherein the power of the cryocooler, the flow of gas entering the liquefaction region, and the pressure within the liquefaction region are each dynamically modulated by the computer control device to achieve predetermined liquefaction performance.

15. The gas liquefaction system of claim 1, wherein the at least one control device is configured to control pressure within the interior tank during operation above the critical pressure of the helium gas being liquefied.

16. The gas liquefaction system of claim 1, wherein the at least one gas pressure control mechanism and the at least one control device are configured to control pressure within the interior tank based on a measured temperature of fluid within the interior tank.

17. The gas liquefaction system of claim 16, wherein the at least one gas pressure control mechanism includes an electrically controlled valve in communication with the at least one control device for controlling pressure within the interior tank.

* * * * *